US011293392B2

(12) United States Patent
Zhang et al.

(10) Patent No.: US 11,293,392 B2
(45) Date of Patent: Apr. 5, 2022

(54) METHODS AND SYSTEMS FOR A FUEL INJECTOR

(71) Applicant: Ford Global Technologies, LLC, Dearborn, MI (US)

(72) Inventors: Xiaogang Zhang, Novi, MI (US); Jianwen James Yi, West Bloomfield, MI (US); Joseph F. Basmaji, Waterford, MI (US); Mark Meinhart, Dexter, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 44 days.

(21) Appl. No.: 16/280,933

(22) Filed: Feb. 20, 2019

(65) Prior Publication Data

US 2020/0263649 A1 Aug. 20, 2020

(51) Int. Cl.

| | |
|---|---|
| ***F02M 61/18*** | (2006.01) |
| ***F02M 55/00*** | (2006.01) |
| *F02B 23/10* | (2006.01) |
| *F02B 75/12* | (2006.01) |

(52) U.S. Cl.

CPC ..... *F02M 61/184* (2013.01); *F02M 55/008* (2013.01); *F02M 61/1846* (2013.01); *F02B 23/104* (2013.01); *F02B 2075/125* (2013.01)

(58) Field of Classification Search

CPC ..... F02B 2023/103; F02B 2023/104; F02M 63/004; F02M 63/0042; F02M 63/0061; F02M 61/184; F02M 61/1846; F02M 55/008

USPC ..... 123/305

See application file for complete search history.

(56) References Cited

U.S. PATENT DOCUMENTS

| | | | | |
|---|---|---|---|---|
| 6,053,421 | A | 4/2000 | Chockley | |
| 6,260,537 | B1 | 7/2001 | Lamb et al. | |
| 6,394,070 | B1 * | 5/2002 | Angelino | F02M 47/043 123/300 |
| 7,159,802 | B2 | 1/2007 | Oomura et al. | |
| 8,347,851 | B2 * | 1/2013 | Okumura | F02M 45/086 123/299 |
| 2011/0030635 | A1 * | 2/2011 | Siuchta | F02M 57/025 123/1 A |

FOREIGN PATENT DOCUMENTS

| | | | | |
|---|---|---|---|---|
| KR | 20150092326 A | * | 8/2015 | F02M 61/182 |

OTHER PUBLICATIONS

Zhang, X. et al., "Methods and Systems for a Fuel Injector," U.S. Appl. No. 16/149,877, filed Oct. 2, 2018, 45 pages.

* cited by examiner

*Primary Examiner* — Logan M Kraft
*Assistant Examiner* — Joshua Campbell
(74) *Attorney, Agent, or Firm* — Geoffrey Brumbaugh

(57) ABSTRACT

Methods and systems are provided for a fuel injector. In one example, a system comprises an injector spool valve having a fuel outlet shaped to flow fuel to different portions of a nozzle inlet based on an actuation of the injector spool valve, thereby adjusting a fuel injection angle of a fuel injection.

18 Claims, 10 Drawing Sheets

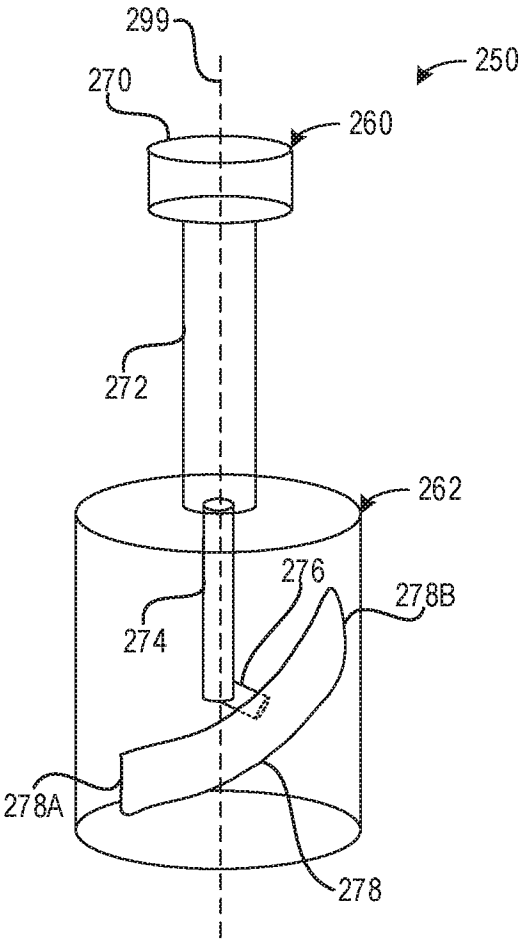
FIG. 2B
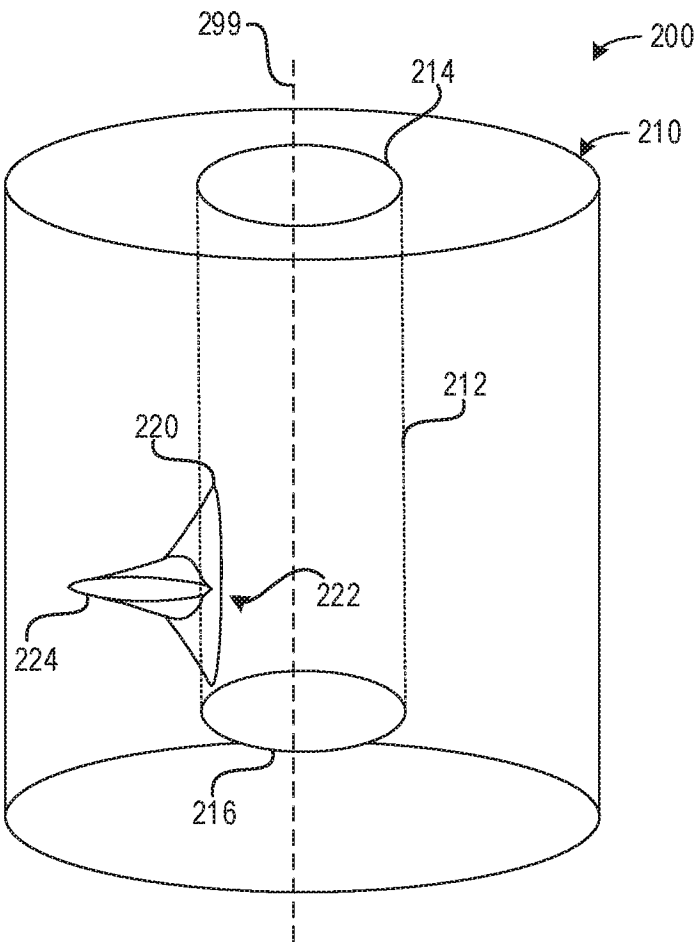
FIG. 2A
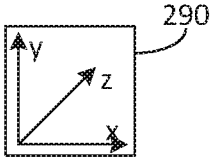

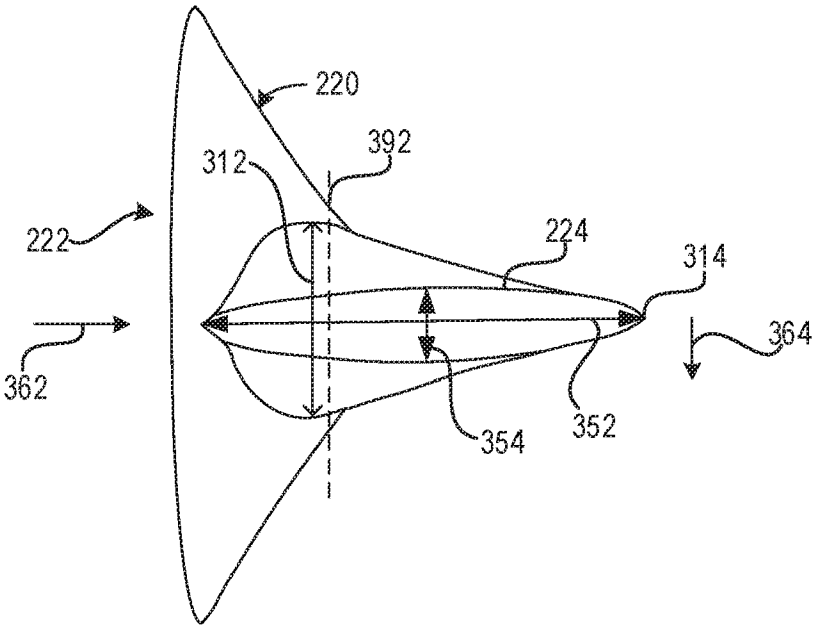
FIG. 3B
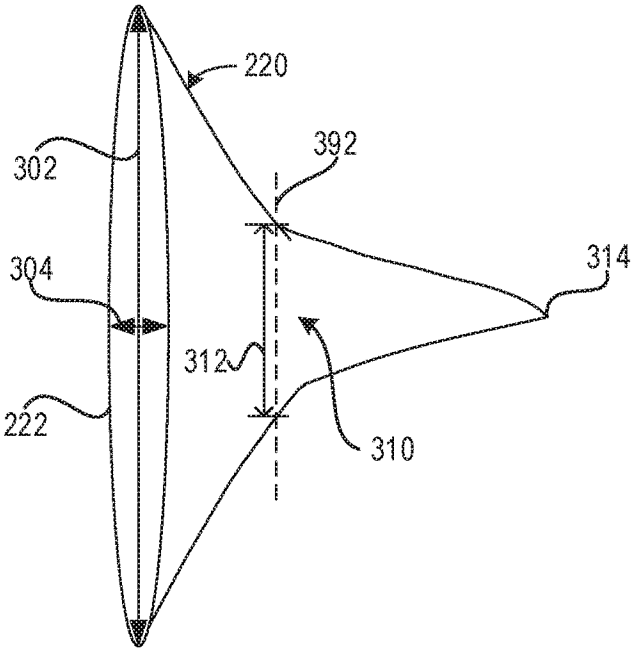
FIG. 3A
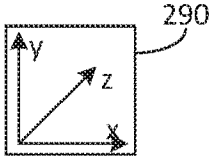

METHODS AND SYSTEMS FOR A FUEL INJECTOR

FIELD

The present description relates generally to a fuel injector comprising an injector body having an injector spool valve shaped to actuate within the injector body.

BACKGROUND/SUMMARY

In engines, air is drawn into a combustion chamber during an intake stroke by opening one or more intake valves. Then, during the subsequent compression stroke, the intake valves are closed, and a reciprocating piston of the combustion chamber compresses the gases admitted during the intake stroke, increasing the temperature of the gases in the combustion chamber. In some systems, fuel is then injected into the hot, compressed gas mixture in the combustion chamber. The mixture may be ignited via a spark or upon reaching a threshold pressure. The combusting air-fuel mixture pushes on the piston, driving motion of the piston, which is then converted into rotational energy of a crankshaft.

However, the inventors have recognized potential issues with such engines. As one example, fuel may not mix evenly with the air in the combustion chamber due to insufficient time, leading to the formation of dense fuel pockets in the combustion chamber. These dense regions of fuel may produce soot as the fuel combusts. As such, engines may include particulate filters for decreasing an amount of soot and other particulate matter expelled to the environment. However, such particulate filters lead to increased manufacturing costs and increased fuel consumption during active regeneration of the filter. Furthermore, fuel economy due to the dense fuel pockets is reduced.

Modern technologies for combating engine soot output and poor air/fuel mixing may include features for entraining air with the fuel prior to injection. This may include passages arranged in an injector body, as an insert into the engine head deck surface, or integrated in an engine head. Ambient air mixes with the fuel, cooling the injection temperature, prior to delivering the mixture to the compressed air in the cylinder. By entraining cooled air with the fuel prior to injection, a lift-off length is lengthened and start of combustion is retarded. This limits soot production through a range of engine operating conditions, reducing the need for a particulate filter.

However, the inventors herein have recognized potential issues with such injectors. As one example, the previously described fuel injectors may no longer sufficiently prevent soot production to a desired level in light of increasingly stringent emissions standards. Additionally, the previously described fuel injectors may only limit soot production in diesel engines, where air/fuel have a longer duration of time to mix before combustion than in spark-ignited engines. Furthermore, these fuel injectors may not extend a duration in which fuel may be injected, which may further decrease air/fuel mixing.

In one example, the issues described above may be addressed by a system comprising a fuel injector positioned to inject directly into a combustion chamber. The fuel injector further comprising an injector spool valve shaped to rotate within an injector body of the fuel injector to which a nozzle is physically coupled, the injector spool valve comprising a curved rectangular fuel outlet shaped to flow fuel to different portions of a nozzle inlet based on a rotation of the injector spool valve. In this way, a fuel injection window of the fuel injector may be expanded to overlap an intake and a compression stroke by aligning different portions of the curved rectangular fuel outlet to different portions of the nozzle inlet based on the rotation of the injector spool valve.

As one example, a nozzle outlet may be shaped to direct fuel away from a piston surface to avoid piston wetting. By doing this, the injector spool valve may be actuated to begin injecting fuel from the fuel injector at a beginning of the intake stroke and stop injecting at an end of the compression stroke. This may enhance air/fuel mixing in the combustion chamber which may decrease fuel pockets and other contributors to increased emissions. As such, fuel economy may increase and emissions may decrease as a result of the fuel injector.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2A illustrates an embodiment of an injector body and a nozzle of an injector.

FIG. 2B illustrates an embodiment of an injector spool valve of an injector.

FIGS. 3A and 3B illustrate separate views of the nozzle.

FIGS. 1-5D and 8A-8D are shown approximately to scale, although other relative dimensions may be used, if desired.

DETAILED DESCRIPTION

Figure 1:
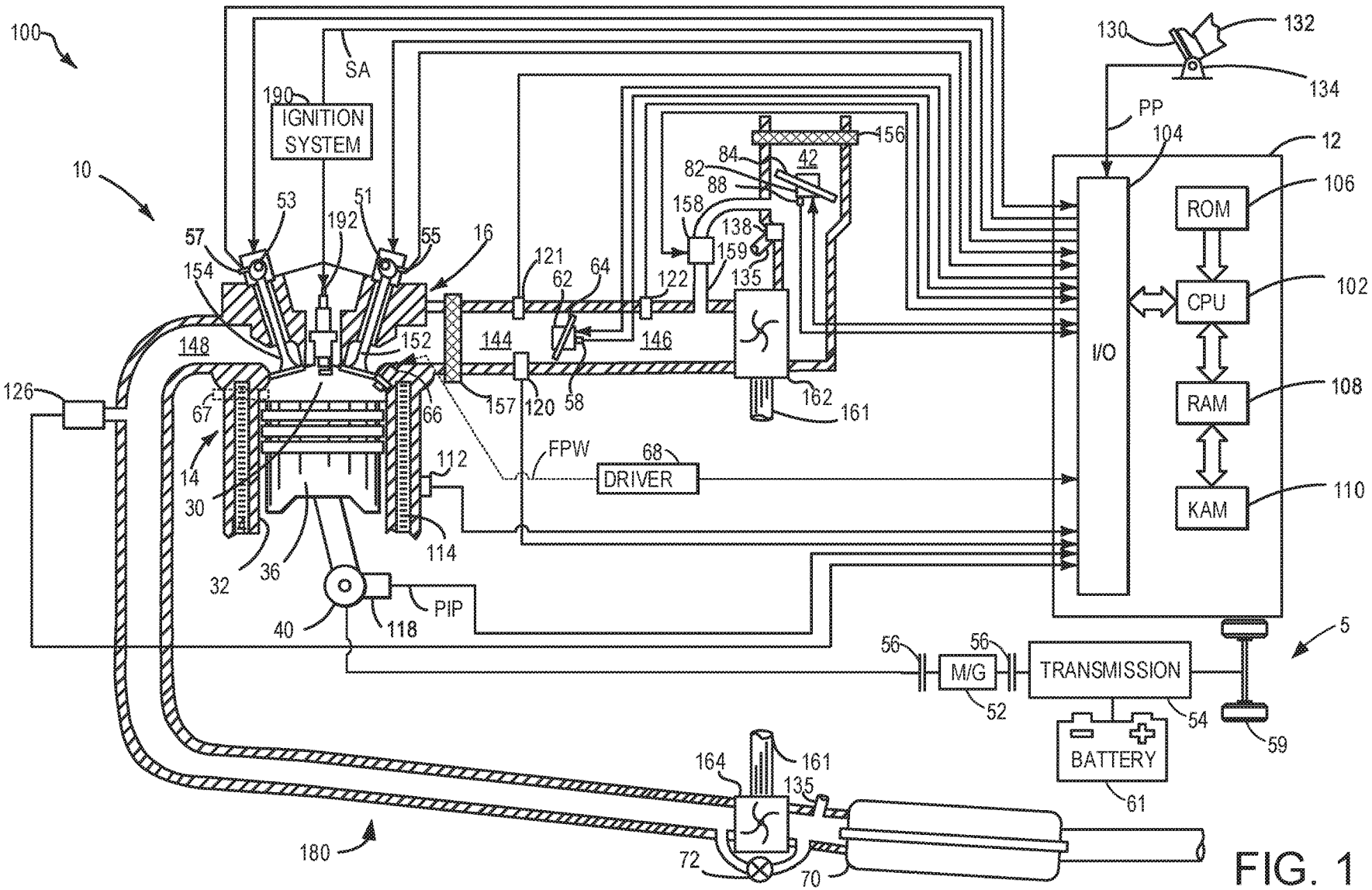
FIG. 1 illustrates a schematic of an engine included in a hybrid vehicle.

The following description relates to systems and methods for a fuel injector. In one example, the fuel injector is positioned to inject into a combustion chamber of an internal combustion engine. The engine may be included in a hybrid vehicle, such as the hybrid vehicle illustrated in FIG. 1. Optionally, the fuel injector may be configured as a side-mounted fuel injector, as shown in FIG. 1.

The fuel injector may comprise an injector body and a nozzle, wherein the nozzle may comprise an elliptically shaped opening for injecting fuel into the combustion chamber. An injector spool valve may be actuated to adjust a position of a fuel outlet shaped to flow fuel to the nozzle, wherein adjusting the position of the fuel outlet also adjusts a fuel flow through the nozzle. An example of the injector body and nozzle are shown in FIG. 2A and the injector spool valve is shown in FIG. 2B. Detailed views of the nozzle are shown in FIGS. 3A and 3B.

FIGS. 4A, 4B, 4C, 4D, and 4E illustrate various positions of the nozzle and the injector spool valve, wherein each of the positions may provide a different injection angle and penetration. Examples of different injection patterns for four open positions of the fuel injector are shown in FIGS. 5A, 5B, 5C, and 5D.

Figure 6:
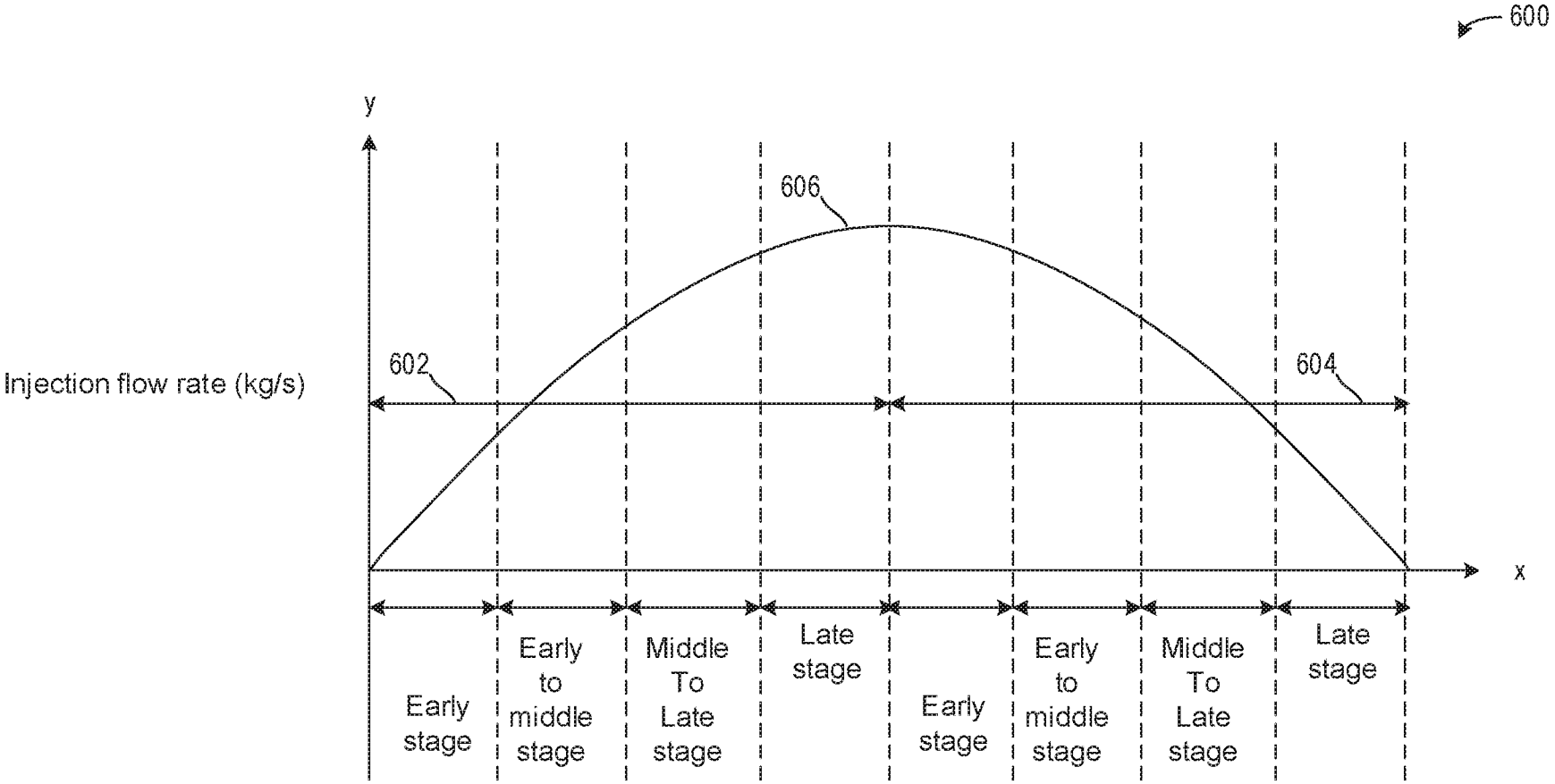
FIG. 6 illustrates an injection flow rate for an injection schedule relative to an engine cycle.
Figure 7:
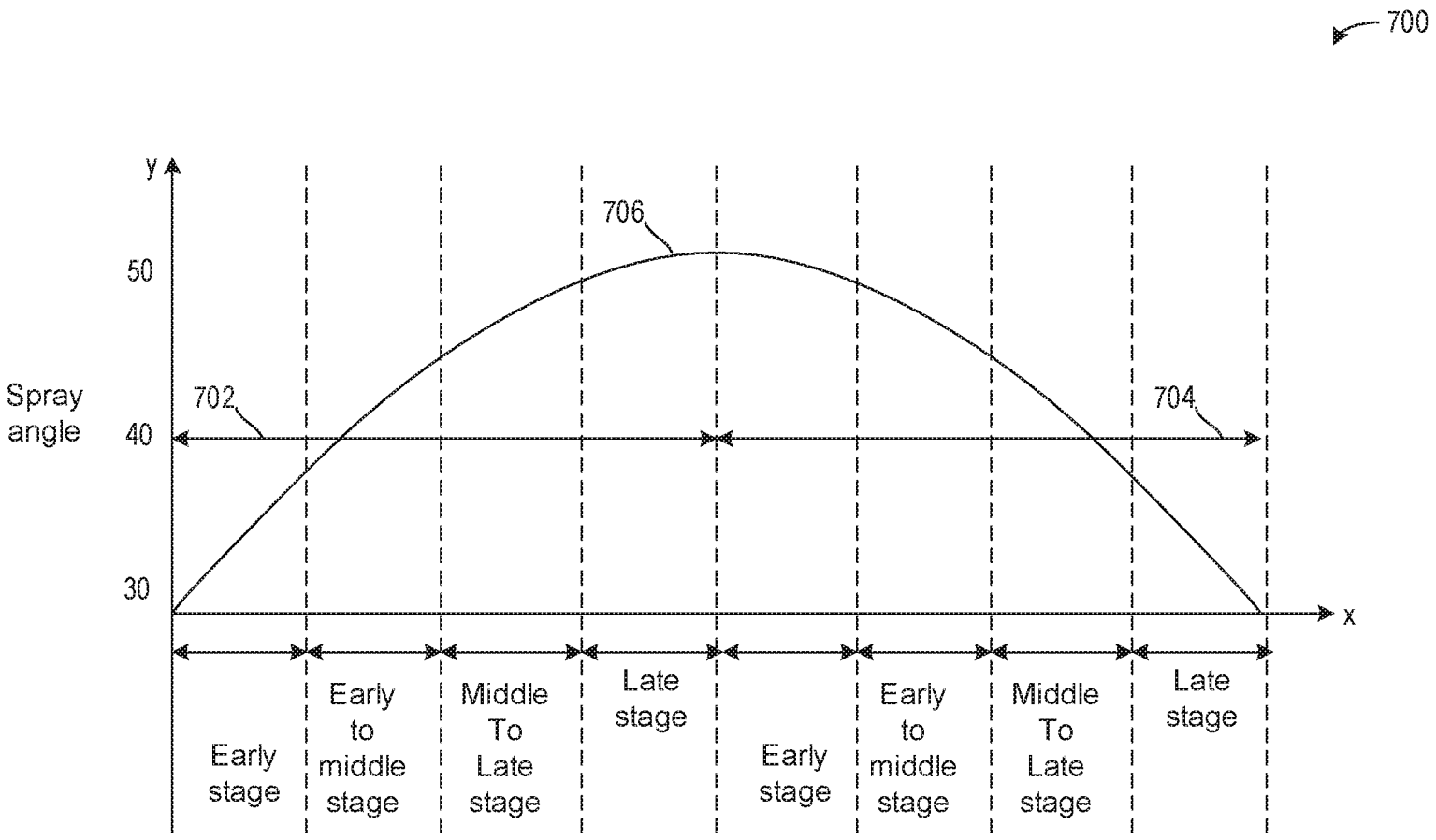
FIG. 7 illustrates an injection angle for an injection schedule relative to an engine cycle.

FIG. 6 shows a plot illustrating an injection flow rate through the fuel injector at different stages of an intake stroke. FIG. 7 shows a plot illustrating an injection spray angle at different stages of the intake stroke. FIGS. 8A, 8B, 8C, and 8D show various positions of a further embodiment of the injector spool valve.

FIGS. 1-5D and 8A-8D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. Optionally, additionally or alternatively, the cylinder block 14 may include a side-mounted fuel injector 67, illustrated by a dashed box. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Fuel injector 66 may be a first fuel injector 66, wherein the combustion chamber 30 may comprise a second fuel injector 67. In some examples, the combustion chamber 30 may comprise only one of the first fuel injector 66 and the second fuel injector 67. The second fuel injector 67 is mounted directly into the cylinder wall 32 of the combustion chamber 30.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC).

During the compression stroke, intake valve 152 and exhaust valve 154 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 192, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 154 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples. Below, injection timings, angles, and pressure may be described relative to piston 36 movement.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used.

While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 61 to provide torque to vehicle wheels 59. Electric machine 52 may also be operated as a generator to provide electrical power to charge battery 61, for example during a braking operation.

The controller 12 receives signals from the various sensors of FIG. 1 and employs the various actuators of FIG. 1 to adjust engine operation based on the received signals and instructions stored on a memory of the controller. For example, adjusting an actuator of the first fuel injector 66 and/or the second fuel injector 67 may be based on a PIP signal received from Hall effect sensor 118. The actuator may be adjusted to adjust an injection angle of one or more of the injectors to avoid piston wetting. Additionally, the controller 12 may command a signal to the injector to adjust a fuel injection pressure, wherein the pressure is increased as the piston moves closer to BDC.

Turning now to FIG. 2A, it shows an embodiment 200 of an injector body 210. The injector body 210 may be used with the first fuel injector 66 and/or the second fuel injector 67 of FIG. 1, in one example. In one example, the injector body 210 may be used similarly to only the second fuel injector 67, wherein the injector body 210 is an injector body for a fuel injector mounted directly into a side combustion chamber wall of a combustion chamber, where the fuel injector is positioned to inject directly into the combustion chamber.

An axis system 290 is shown comprising three axes, namely an x-axis parallel to a horizontal direction, a y-axis parallel to a vertical direction, and a z-axis perpendicular to each of the x- and y-axes. A central axis 299 may extend through a geometric center of the injector body 210 parallel to the y-axis.

The injector body 210 may comprise a cylindrical shape. However, the injector body 210 may comprise other shapes, including a cube-shape, a rectangular prism shape, pyramidal shape, spherical shape, and other three-dimensional shapes without departing from a scope of the present disclosure. A radius of the injector body 210 may extend outward from the central axis 299 along a plane lying along the x- and z-axes.

A nozzle 220 may be coupled to the injector body 210. The nozzle 220 may be fluidly coupled to a hollow interior 212 of the injector body 210 and to the combustion chamber. More specifically, the nozzle 220 may comprise a nozzle inlet 222 fluidly coupled to the hollow interior 212 and a nozzle outlet 224 fluidly coupled to the combustion chamber. As shown in the FIG. 2A and as will be described in greater detail below with respect to FIGS. 3A and 3B, the nozzle may transition from an oval shape at the nozzle inlet 222, to a circular shape at a nozzle center, and back to an oval shape at the nozzle outlet 224.

The injector body 210 may further comprise a first opening 214 for admitting an injector spool valve, shown in FIG. 2B, into the hollow interior 212. A volume of the hollow interior 212 may be defined by the first opening 214 and a bottom 216, wherein the bottom 216 may be a physical surface blocking further movement of the injector spool valve through the injector body 210. In one example, the hollow interior 212 comprises a cylindrical-shape, similar to but smaller than the cylindrical-shape of the injector body 210. As shown, while the first opening 214 is arranged at a top surface of the injector body 210, the bottom 216 may be spaced away from a bottom surface of the injector body 210. Thus, the injector spool valve may be suspended within the injector body 210, in some examples.

Turning now to FIG. 2B, it shows an embodiment 250 of an injector spool valve 260 shaped to be used with the injector body 210 and nozzle 220 of FIG. 2A. In one example, the injector spool valve 260 may be arranged in the hollow interior 212 of the injector body 210. An injector spool valve body 262 may comprise a cylindrical shape sized according to a size of the hollow interior 212. As such, the diameter of the injector spool valve body 262 may be slightly smaller than the diameter of the hollow interior 212 such that the injector spool valve body 262 may be arranged within the hollow interior 212 without movement in the radial directions. Additionally, the injector spool valve 260 may still be actuated, either rotationally about the central axis 299 or vertically along the central axis 299.

The injector spool valve 260 may comprise an actuator 270. The actuator 270 is electrically actuated in the example of FIG. 2B, however, it will be appreciated that the actuator 270 may be actuated via hydraulic or mechanical forces without departing from the scope of the disclosure. The actuator 270 may be coupled (e.g., physically coupled) to a valve stem 272 extending from the actuator 270 to a first fuel path 274. The first fuel path 274 may extend along a direction parallel to the central axis 299. A second fuel path 276 may be fluidly coupled to the first fuel path 274, wherein the second fuel path 276 may extend in a radially outward direction, relative to the central axis 299 and perpendicular to the first fuel path 274. The actuator 270 may be configured to receive instructions from a controller (e.g., controller 12 of FIG. 1) to actuate and adjust a fuel injection from the nozzle 220 as instructed.

Diameters of the first fuel path 274 and the second fuel path 276 may be substantially equal, however, the diameters may be unequal in some embodiments without departing from the scope of the present disclosure. The second fuel path 276 may be fluidly coupled to a fuel outlet 278. The fuel outlet 278 may comprise a curved, rectangular shape. That is to say, the fuel outlet 278 may comprise a rectangular shape, wherein corners and longitudinal sides of the fuel outlet 278 are curved. In one example, the cross-section may be rectangular. Additionally or alternatively, the fuel outlet 278 may comprise a curved parallelogram shape. The curve of the fuel outlet 278 may be such that a first end 278A is farther from the valve stem 272 than a second end 278B. The fuel outlet 278 may be shaped to provide fuel to the nozzle inlet 222. More specifically, the fuel outlet 278 may be shaped to provide fuel to different portions of the nozzle inlet 222, which may adjust an injection angle and/or fuel spray penetration depth of a fuel injection, as will be described below.

In one example, the fuel outlet 278 comprises a curved rectangular shape, wherein the curved rectangular shape comprises curved longitudinal and lateral sides, and where an angle formed between an intersection of the curved longitudinal and lateral sides is greater than or less than 90 degrees. In one example, the angle may be between 100 and 130 degrees or 60 to 85 degrees.

Turning now to FIG. 3A, it shows a detailed view 300 of the nozzle 220. As such, components previously described may be similarly numbered in this figure and in subsequent figures. In the example of FIG. 3A, a portion of the nozzle 220 from where the nozzle outlet 224 is spaced away is shown. The nozzle inlet 222 comprises an oval shape as shown. Additionally or alternatively, the nozzle inlet 222 may comprise an elliptical shape. In some examples, the nozzle inlet 222 may comprise curved motifs of other shapes including but not limited to a triangle, square, rectangle, and the like.

The nozzle inlet 222 may comprise a longitudinal length 302 and a lateral length 304, each corresponding to a maximum and a minimum diameter of the nozzle inlet 222. The longitudinal length 302 may be greater than the lateral length 304 and be substantially equal to the maximum diameter. In some examples, the longitudinal length 302 may be at least two times greater than the lateral length 304. In some examples, additionally or alternatively, the longitudinal length 302 may be at least four times greater than the lateral length 304. In some examples, additionally or alternatively, the longitudinal length 302 may be at least six times greater than the lateral length 304. In some examples, additionally or alternatively, the longitudinal length 302 may be at least eight times greater than the lateral length 304. In one example, the longitudinal length 302 is exactly 10 times greater than the lateral length 304. The longitudinal length 302 may be 1.0 mm and the lateral length may be 0.1 mm. In one example, the longitudinal length 302 may be parallel to the central axis of the injector body (e.g., central axis 299 of the injector body 210 of FIG. 2A).

The nozzle 222 may comprise a circular center 310 arranged between the nozzle inlet 222 and a nozzle extreme end 314. The circular center 310 may correspond to a portion of the nozzle 220 at which an interior volume of the nozzle transitions from the nozzle inlet 222 to the nozzle outlet. In one example, a plane, represent by dashed line 392, along which the circular center 310 is arranged may be parallel to the longitudinal length 302. Furthermore, the plane may be spaced away from the nozzle inlet 222 by less than 1.0 mm. In some examples, additionally or alternatively, the plane may be less than 0.5 mm away from the nozzle inlet 222. In one example, the plane is 0.3 mm away from the nozzle inlet 222.

A diameter 312 of the circular center may be larger than the lateral length 304 and smaller than the longitudinal length 302. In some examples, additionally or alternatively, the diameter 312 may be equal to the distance between the plane of the circular center 310 and the nozzle inlet 222. As such, the diameter 312 of the circular center 310 may be equal to 0.3 mm. However, other dimensions for the circular center 310 may be used without departing from the scope of the present disclosure.

Turning now to FIG. 3B, it shows a view 350 of a portion of the nozzle 220 where the nozzle outlet 224 is arranged. The nozzle outlet 224 may be shaped similarly to the nozzle inlet 222. However, as will be described herein, dimensions of the nozzle outlet 224 may differ from dimensions of the nozzle inlet 222.

The nozzle outlet 224 may comprise a longitudinal length 352 and a lateral length 354. The longitudinal length 352 corresponds to a maximum diameter of the nozzle outlet 224 and the lateral length 354 corresponds to a minimum diameter of the nozzle outlet 224. The longitudinal length 352 may be at least two times larger than the lateral length 354. In some examples, additionally or alternatively, the longitudinal length 352 may be at least four times larger than the lateral length 354. In some examples, additionally or alternatively, the longitudinal length 352 may be at least six times larger than the lateral length 354. In some examples, additionally or alternatively, the longitudinal length 352 may be at least eight times larger than the lateral length 354. In one example, the longitudinal length 352 is 0.8 mm and the lateral length 354 is 0.1 mm.

Thus, in the example of FIG. 3B, the lateral length 354 of the nozzle outlet 224 is substantially equal to the lateral length 304 of the nozzle inlet 222 shown in FIG. 3A. However, the orientation of the lateral lengths may be normal to one another. Said another way, the lateral length 304 of the nozzle inlet 222 may be oriented parallel to the z-axis and the lateral length 354 of the nozzle outlet 224 may be oriented parallel to the y-axis.

Furthermore, the longitudinal length 352 of the nozzle outlet 224 is smaller than the longitudinal length 302 of the nozzle inlet 222 shown in FIG. 3A. As shown, the longitudinal length 352 is 80% of the longitudinal length 302. This sizing may provide the desired injection angles and fuel spray penetration described below. However, it will be appreciated that each of the nozzle inlet 222 and the nozzle outlet 224 may be reshaped and resized to accommodate various combustion chamber shapes and sizes. As such, in some examples, the longitudinal length 352 of the nozzle outlet 224 may be larger than the longitudinal length 302 of the nozzle inlet 222. An orientation of the longitudinal length 352 may be normal to the orientation of the longitudinal length 302. More specifically, the longitudinal length 354 is shown oriented along the x-axis and the longitudinal length 302 is shown oriented along the y-axis.

As shown, the orientation of the nozzle inlet 222 and the nozzle outlet 224 may result in a twisted nozzle 220 shape. The circular center 310 may be arranged at a midway point of the twist. The twist may affect fuel flow through the nozzle 220 to generate a desired fuel injection angle and penetration at various piston positions.

Fuel may enter the nozzle 220 via the nozzle inlet 222, where the fuel may flow toward the circular center 310. Fuel leaving the circular center 310 may be expelled from the nozzle 220 via the nozzle outlet 224. The fuel may be reoriented due to the different orientations of the nozzle inlet 222 and the nozzle outlet 224, such that the fuel enters the nozzle 220 along a first direction 362 and exits the nozzle 220 along a second direction 364, opposite the first direction 362. In one example, the first direction 362 is parallel to the x-axis and the second direction 364 is parallel to the z-axis.

As described above, the nozzle 220 may be positioned at a side wall of the combustion chamber. Thus, the nozzle 220 may be arranged between a fire deck and a piston of the combustion chamber. The nozzle outlet 224 may be directed toward the fire deck and/or a spark plug (e.g., spark plug 192 of FIG. 1). Additionally or alternatively, the nozzle outlet 224 may be directed toward another portion of the side wall of the combustion chamber.

Figure 4A:
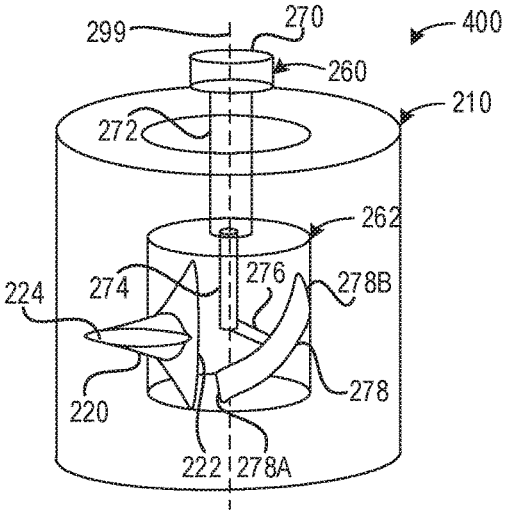
FIGS. 4A, 4B, 4C, 4D, and 4E illustrate different injector positions for the injector body and the injector spool valve.
Figure 4B:
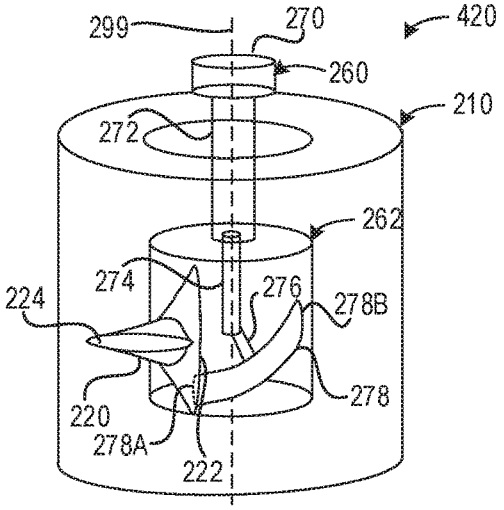
Figure 4C:
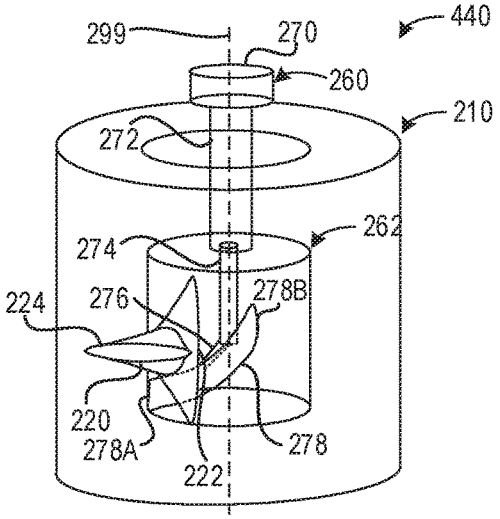
Figure 4D:
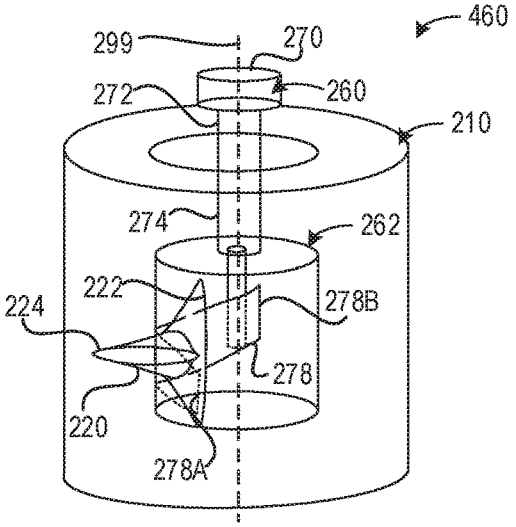
Figure 4E:
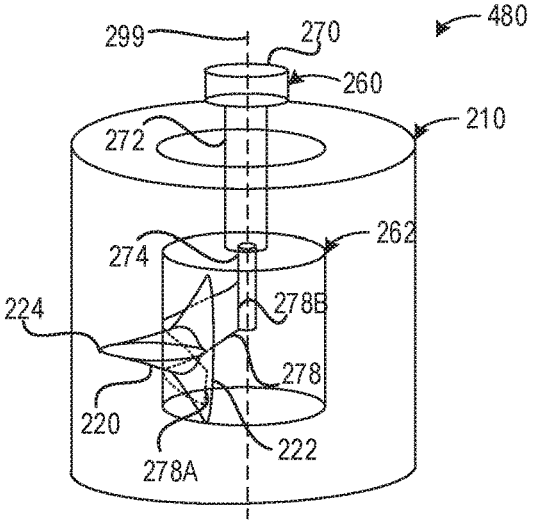

Turning now to FIGS. 4A, 4B, 4C, 4D, and 4E, they show various positions of the fuel injector body 220 and the injector spool valve 260. More specifically, FIG. 4A shows a closed position 400. FIG. 4B shows a first injection position 420. FIG. 4C shows a second injection position 440. FIG. 4D shows a third injection position 460. FIG. 4E shows a fourth injection position 480.

In one example, the injector spool valve 260 may be rotated clockwise about the central axis 299 as it progresses from the closed position to the fourth injection position, wherein the first through third injection positions occur therebetween. The positions are selected in response to a piston position, in one example.

Turning now to FIG. 4A, the closed position 400 shows the fuel outlet 278 being misaligned with the nozzle inlet 222. More specifically, an overlap between the fuel outlet 278 and the nozzle inlet 222 may not occur in the closed position 400. As such, fuel flow from the fuel outlet 278 to the nozzle inlet 222 may be blocked, and a fuel injection may not occur.

Turning now to FIG. 4B, the first injection position 420 is shown. In one example, the first injection position 420 may differ from the closed position 400 in that the fuel outlet 278 is rotated relative to the closed position. More specifically, the fuel outlet 278 may be rotated 30 degrees relative to the central axis 299. As such, the central axis 299 may also be an axis of rotation, about which the fuel outlet 278 may be rotated.

The electric actuator 270 may receive a signal from a controller (e.g., controller 12 of FIG. 1) to rotate the fuel outlet 278. The signal may be in response to a PIP from Hall effect sensor 118, in one example. The electric actuator 270 may rotate the shaft 272, which may rotate the first fuel path 274. Additionally, the second fuel path 276 may rotate, thereby adjusting a radial direction in which the second fuel path 276 is directed. The fuel outlet 278 may also be rotated. As shown, an overlap between the first end 278A of the fuel outlet 278 and the nozzle inlet 222 may occur as a result of the rotation, thereby allowing fuel from the fuel outlet 278 to flow through the nozzle inlet 222 and into the nozzle 220. In one example, the fuel outlet 278 may be fluidly coupled to a bottom portion of the nozzle inlet 222. In this way, a fuel injection may occur, wherein fuel is injected into the combustion chamber via the nozzle outlet 224.

Turning now to FIG. 4C, the second injection position 440 is shown. In one example, the second injection position 440 may differ from the first injection position 420 in that the second fuel path 276 and the fuel outlet 278 are rotated relative to the position shown in the first injection position 420. More specifically, the fuel outlet 278 may be rotated 30 degrees clockwise relative to the central axis 299. In this way, the fuel outlet 278 may be rotated 60 degrees relative to the closed position.

The second injection position 440 may comprise a greater amount of overlap between the fuel outlet 278 and the nozzle inlet 222 compared to the first injection position 420. For example, the bottom portion and a lower central portion of the nozzle inlet 222 may be fluidly coupled to the fuel outlet 278 in the second injection position 440. In one example, the bottom portion and the lower central portion are below the lateral length 304 of the nozzle inlet 222 of FIG. 3A. As such, an injection angle of a fuel injection occurring in the second injection position 440 may be different than an injection angle of a fuel injection occurring in the first injection position 420. More specifically, the injection angle of the second injection position 440 may be greater than the injection angle of the first injection position 420. Additionally, a penetration depth of the fuel injection in the second injection position 440 may be greater than a penetration depth of the fuel injection in the first injection position 420, wherein the penetration depth may correspond to a distance into the combustion chamber the injection travels. However, the fuel outlet 278 is rotated such that the first end 278A is rotational positioned past the nozzle inlet 222 and is no longer fluidly coupled to the nozzle inlet 222. More specifically, a portion of the fuel outlet 278 between the first end 278A and the second end 278B is fluidly coupled to the nozzle inlet 222, wherein the portion is closer to the first end 278A than the second end 278B.

Turning now to FIG. 4D, the third injection position 460 is shown. In one example, the third injection position 460 may differ from the first and second injection positions 420, 440 in that the second fuel path 276 and the fuel outlet 278 are rotated further clockwise to the positions shown in the first and second injection positions 420, 440. More specifically, the second fuel path 276 and the fuel outlet 278 may be rotated 30 degrees relative to the second injection position 440 and 60 degrees relative to the first injection position 420. In one example, the third injection position 460 is rotated 90 degrees relative to the closed position.

The third injection position 460 may comprise where the fuel outlet 278 is fluidly coupled to the central portion and a top portion of the nozzle inlet 222. In one example, the central portion in the third injection position 460 is an upper central portion above the lateral length of the nozzle inlet 222. Furthermore, a portion of the fuel outlet 278 between the first end 278A and the second end 278B is fluidly coupled to the nozzle inlet 222, wherein the portion is closer to the second end 278B than the first end 278A. As such, an injection angle and a penetration depth of a fuel injection during the third injection position 460 may be different than the angle and penetration of the fuel injections during the first and second injection positions 420, 440.

Turning now to FIG. 4E, the fourth injection position 480 is shown. In one example, the fourth injection position 480 may differ from the first, second, and third injection positions 420, 440, and 440 in that the second fuel path 276 and the fuel outlet 278 are rotated further clockwise to the positions shown in the first, second, and third injection positions 420, 440, and 460. More specifically, the second fuel path 276 and the fuel outlet 278 may be rotated 30 degrees relative to the third injection position 460, 60 degrees relative to the second injection position 440, and 90 degrees relative to the first injection position 420. In one example, the fourth injection position 480 is rotated 120 degrees relative to the closed position.

The fourth injection position 480 may comprise where the fuel outlet 278 is fluidly coupled to the top portion of the nozzle inlet 222. As such, an injection angle and a penetration of a fuel injection during the fourth injection position 480 may be different than the angle and penetration of the fuel injections during the first, second, and third injection positions 420, 440, and 460. In one example, the injection angle may be substantially equal to 30 degrees in the first injection position 420, wherein the injection angle increases to about 50 degrees in the fourth injection position 480, wherein the second and third injection positions 440 and 460 include injection angles between 30 and 50.

Figure 5A:
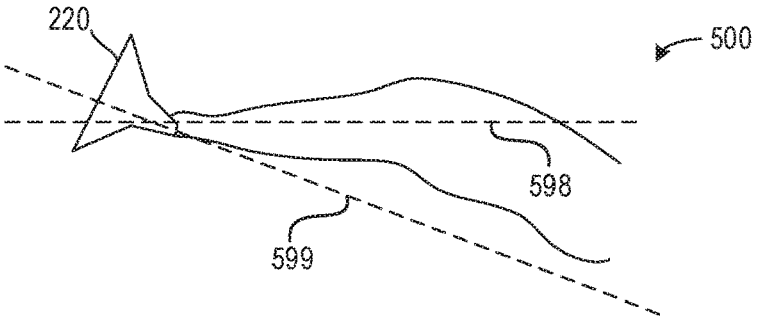
FIGS. 5A, 5B, 5C, and 5D illustrate different injection patterns of the different injector positions of the injector.

Turning now to FIGS. 5A, 5B, 5C, and 5D, they show various injection patterns for the first, second, third, and fourth injection positions illustrated in FIGS. 4B through 4E, respectively. FIG. 5A illustrates a first fuel injection 500, which may correspond to the first injection position 420 of FIG. 4B. The fuel injection 500 may thus result from the fuel outlet being fluidly coupled to only a bottom portion of the nozzle inlet. The resulting fuel injection 500 may be away from a center line 599 of the nozzle, wherein the injection may be directed in a horizontal direction 598 of the combustion chamber. The horizontal direction may be perpendicular to a direction of oscillation of the piston of the combustion chamber. Additionally or alternatively, the fuel injection 500 may be less angled to the horizontal direction than other injections of the nozzle 220. In one example, the first injection position 420 may be selected during an early stage of an intake stroke, where a piston is closest to top-dead center (TDC). As such, the fuel injection 500 may be shaped to avoid piston surface wetting while still providing a fuel injection as early in the intake stroke as possible to increase fuel/air mixing.

Figure 5B:
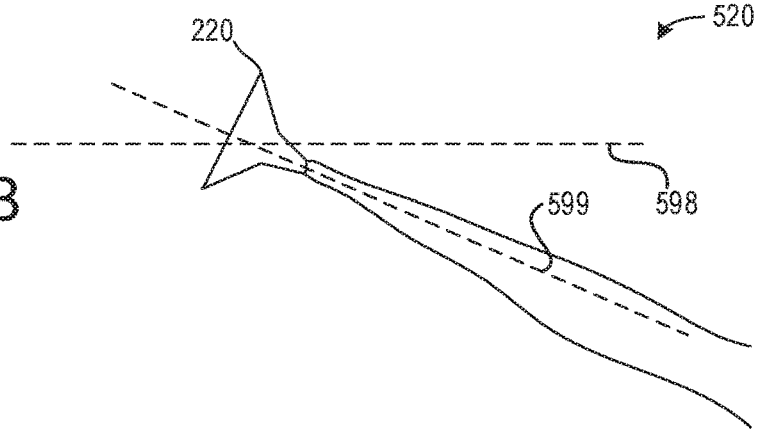

FIG. 5B illustrates a second fuel injection 520, which may correspond to the second injection position 440 of FIG. 4C. The fuel injection 520 may thus result from the fuel outlet being fluidly coupled to only a bottom and a central portion of the nozzle inlet. The resulting fuel injection 520 may follow along the central line 599 of the nozzle outlet, wherein the injection may be directed toward a center of the combustion chamber. In this way, the second fuel injection 520 may be more angled to the horizontal direction 599 of the combustion chamber than the first fuel injection 500. In one example, the second injection position 440, which may produce the second fuel injection 520, may be selected during an early-to-middle stage of an intake stroke, where a piston is closer to TDC than to bottom-dead center (BDC).

Figure 5C:
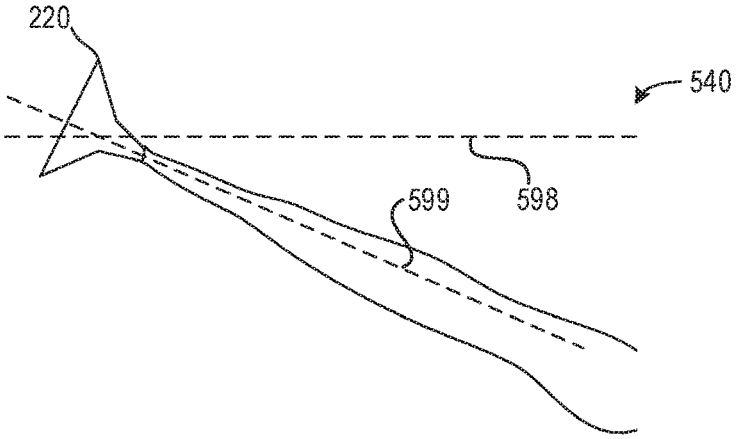

FIG. 5C illustrates a third fuel injection 540, which may correspond to the third injection position 460 of FIG. 4D. The third fuel injection 540 may result from the fuel outlet being fluidly coupled to only the central portion and a top portion of the nozzle inlet. The third fuel injection 540 may follow along the central line 599 of the nozzle outlet, wherein the injection may be directed toward the center of the combustion chamber. In one example, relative to the second fuel injection 520, the third fuel injection 540 may be directed to a lower portion of the center of the combustion chamber due to the piston being closer to a BDC position, thereby providing more space for the fuel to enter the combustion chamber without wetting the piston surface. As such, the third fuel injection 540 may be more angled to the horizontal direction 598 than the second fuel injection 520. In one example, the third fuel injection is selected during a middle-to-late stage of an intake stroke.

Figure 5D:
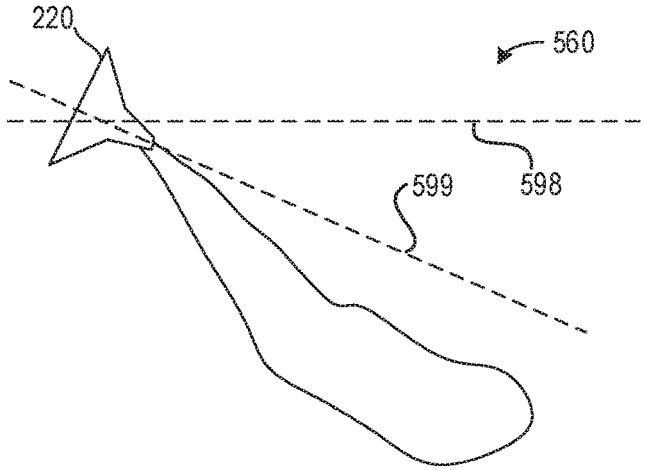

FIG. 5D illustrates a fourth fuel injection 560, which may correspond to the fourth injection position 480 of FIG. 4E. The fourth fuel injection 560 may result from the fuel outlet being fluidly coupled to only the top portion of the nozzle inlet. The fourth fuel injection 560 may follow angled to the central line 599 of the nozzle outlet, wherein the injection may be directed a bottom portion of the combustion chamber. In one example, relative to the third fuel injection 540, the fourth fuel injection 560 may be directed to a lower portion of the combustion chamber due to the piston being closer or at the BDC position, thereby providing more space for the fuel to enter the combustion chamber without wetting the piston surface. Additionally or alternatively, the fourth fuel injection 560 may be more angled than each of the first, second, and third fuel injections 500, 520, and 540, wherein the fuel injection angle may be measured between the horizontal direction 598 and the injection. In one example, the fourth fuel injection 560 is selected during a late stage of an intake stroke.

Turning now to FIG. 6, it shows a plot 600 illustrating an injection flow rate adjustment 606 based on a piston position. The plot 600 illustrates an increase of an injection flow rate as the intake stroke progresses. The duration of the intake stroke is illustrated by double-headed arrow 602. Double headed arrow 604 may represent a duration of a compression stroke. The injection flow rate 606 may increase through the intake stroke such that the injection flow rate is higher in the late stage of the injection stroke than a middle to late stage, wherein the flow rate in the middle to late stage is higher than the flow rate in an early to middle stage, and where the flow rate in the early to middle stage is higher than a flow rate in the early stage.

In one example, the early stage of the intake stroke, which may include where the piston is at or near TDC, may comprise where the first injector position (e.g., first injector position 420 of FIG. 4B) is selected. As such, a first flow rate may be associated with the first injector position, and therefore the first injection 500 of FIG. 5A.

The early to middle stage of the intake stroke, where a piston is closer to TDC than BDC, may comprise where the second injector position (e.g., second injector position 440 of FIG. 4C) is selected. As such, a second flow rate may be associated with the second injector position, and therefore the second injection 520 of FIG. 5B. The second flow rate may be greater than the first flow rate.

The middle to late stage of the intake stroke, where the piston is closer to BDC than TDC, may comprise where the third injector position (e.g., third injector position 460 of FIG. 4D) is selected. As such, a third flow rate may be associated with the third injector position, and therefore the third injection 540 of FIG. 5C. The third flow rate may be greater than each of the second and first flow rates.

The late stage of the intake stroke, where the piston approaches BDC, may comprise where the fourth injector position (e.g., fourth injector position 480 of FIG. 4E) is selected. As such, a fourth flow rate may be associated with the fourth injector position, and therefore the fourth injection 560 of FIG. 5D. The fourth flow rate may be greater than each of the third, second, and first flow rates.

Upon entering the early stage of the compression stroke, where the piston is leaving BDC toward TDC, the injector may remain in the fourth injector position with the injection flow rate being equal to the fourth flow rate. As the compression stroke advances to the early to middle stage, the injection flow rate may decrease from the fourth flow rate to the third flow rate. As such, the early to middle stage of the compression stroke may further comprise switching from the fourth injection position to the third injection position. This may include the electric actuator rotating the valve stem in a counterclockwise direction. That is to say, the direction of rotation illustrated through FIGS. 4A-4E is clockwise and represents a progression of the injector during the intake stroke. During the compression stroke, the injector is rotated counterclockwise, wherein the first through fourth positions are repeated in reverse order, wherein the closed position is reached at the end of the compression stroke (e.g., beginning of a combustion stroke).

Turning now to FIG. 7, it shows a plot 700 illustrating a spray angle and/or an injection angle adjustment 706 as the intake and compression strokes progress, shown by double-headed arrows 702 and 704, respectively. The spray angle may be measured relative to the horizontal direction of the combustion chamber, wherein a larger spray angle may correspond to a fuel injection directed more toward a bottom of the combustion chamber than a smaller spray angle. For example, the spray angle at the early stage of the intake stroke is less than 40 degrees while the spray angle at the late stage of the intake stroke approaches 50 degrees. As such, the fuel injection during the late stage of the intake stroke (e.g., the fourth fuel injection 560 of FIG. 5D) may be directed more toward the bottom of the combustion chamber than the fuel injection during the early stage of the intake stroke (e.g., the first fuel injection 500 of FIG. 5A). In this way, the spray angle may follow a path of the piston, wherein as the piston moves toward BDC, the spray angle may be increased so that a fuel injection is more directed toward the bottom of the combustion chamber. Likewise, as the piston move up toward TDC, the spray angle may be decreased so that the fuel injection is more directed toward the top of the combustion chamber.

In this way, FIGS. 6 and 7 illustrate example fuel injection adjustments as a piston oscillates completes its intake and compression strokes. In one example, the fuel injection angle and injection pressure are proportional to a distance between the piston and the fuel injector. More specifically, as the distance between the piston and the fuel injector increases, which occurs when the piston moves toward BDC, the fuel injection angle and pressure increase. Thus, as the piston approaches TDC and the distance between the piston and the fuel injector decreases, the fuel injection angle and pressure may decrease to avoid wetting the piston surface.

Turning now to FIGS. 8A, 8B, 8C, and 8D, they show an additional embodiment of a fuel injector 800 being actuated through a variety of injection positions. The fuel injector may comprise an injector body 810 and injector spool valve 860 similar to the injector body 210 and injector spool valve 260 illustrated in FIGS. 2A and 2B, respectively. However, the injector spool valve 860 may differ from the injector spool valve 260 in that a valve stem 872, an internal fuel path 874, and a fuel outlet 878 are actuated along a central axis 899 parallel to the central axis 299. As such, an actuator 870 may be configured to adjust a fuel injection position via vertical motion of the fuel outlet 878, rather than a rotation of the outlet as shown in FIGS. 4B through 4E.

More specifically, the fuel injector 800 comprises an injector body 810 and injector nozzle 820 which may be substantially identical to the injector body 210 and the injector nozzle 220 of FIG. 2A. As such, the injector nozzle 820 may comprise a nozzle inlet 822 and a nozzle outlet 824 shaped similarly to the nozzle inlet 222 and the nozzle outlet 224, respectively.

The injector spool valve 860 comprises the actuator 870, the valve stem 872, the internal fuel path 874, and the fuel outlet 878. The internal fuel path 874 may differ from the first fuel path 274 and the second fuel path 276 in that the internal fuel path 874 is a single fuel path. The fuel outlet 878 may differ from the fuel outlet 278 in that the fuel outlet 878 may be an internal fuel volume for fluidly coupling the internal fuel path 874 to the nozzle 820. Additionally, the fuel outlet 878 may be square shaped. Additionally or alternatively, the fuel outlet 878 may comprise a rectangle or other similar shape without departing from the scope of the present disclosure. At any rate, the end of the fuel outlet 878 may not be offset similar to the first and second ends 278A, 278B of the fuel outlet 278. The fuel outlet 878 may flow fuel to different portions of the nozzle inlet 822 based on its actuation relative to the nozzle inlet 820, wherein the fuel outlet 878 overlaps with the different portions of the nozzle inlet 822.

Figure 8A:
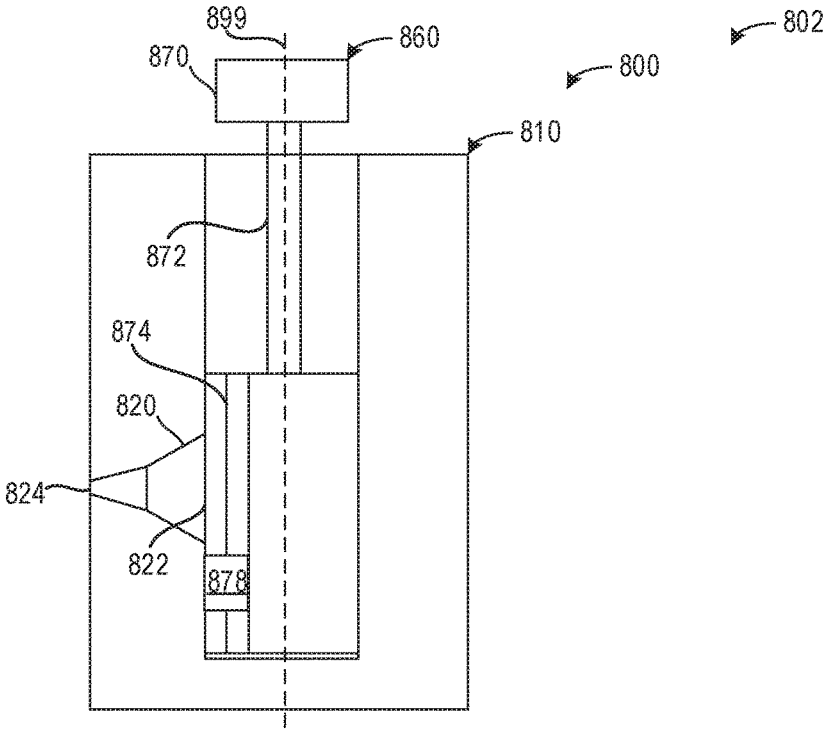
FIGS. 8A, 8B, 8C, and 8D illustrate an additional example of an injector spool valve of the injector.

Turning now to FIG. 8A, it shows a first position 802 of the fuel injector 800. In the first position 802, the fuel outlet 878 may be misaligned with the nozzle inlet 822. As such, a fuel injection may not occur. In this way, the first position 802 may be similar to the closed position 400 of FIG. 4A in that fuel is not injected from the nozzle 820 to the combustion chamber due to no overlap being present between the nozzle inlet 822 and the fuel outlet 878.

Figure 8B:
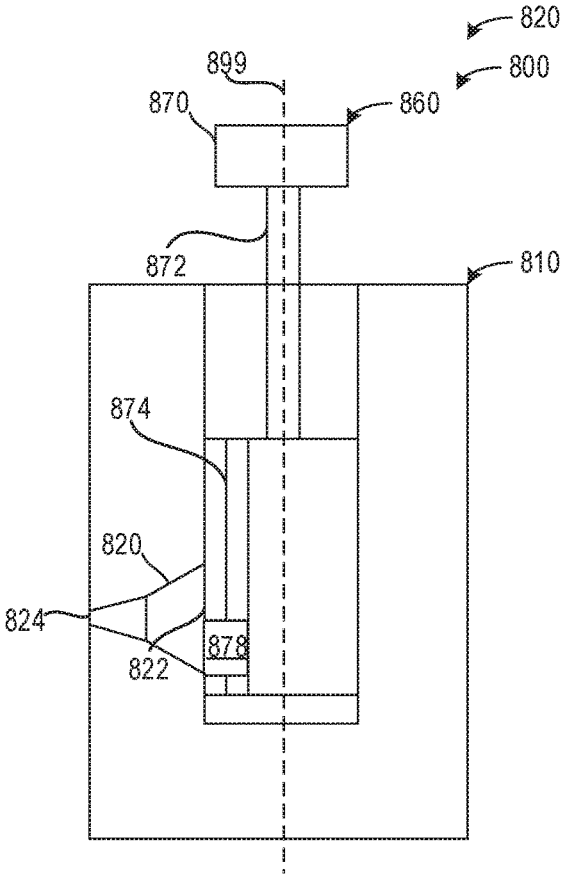

Turning now to FIG. 8B, it shows a second position 820 of the fuel injector 800. In the second position 820, the fuel outlet 878 may be fluidly coupled to a bottom portion of the nozzle inlet 822. As such, a fuel injection 822 occurs. In one example, the fuel injection 822 may be substantially similar to the fuel injection 500 of FIG. 5A. As such, the second position 820 may be substantially similar to the first injection position 420 of FIG. 4B. The fuel outlet 878 overlaps with the bottom portion of the nozzle inlet 822 via an actuation of the fuel outlet 878 along the central axis 899 in a first direction. In one example, the second position is selected during an early stage of an intake stroke or during a late stage of a compression stroke, such that an injection angle and pressure of the injection are relatively low.

Figure 8C:
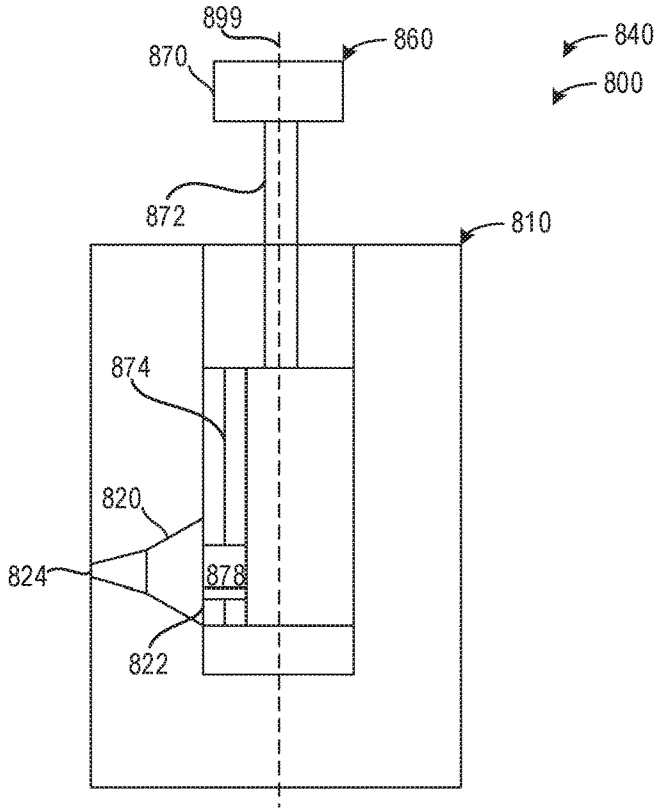

Turning now to FIG. 8C, it shows a third position 840 of the fuel injector 800. In the third position, the fuel outlet 878 may be fluidly coupled to at least a central portion of the nozzle inlet 822. In some examples, the fuel outlet 878 may be fluidly coupled to the bottom portion and the central portion of the nozzle inlet 822 at a beginning of the third position. However, the fuel outlet 878 may be fluidly coupled to the central portion and a top portion of the nozzle inlet 822 at a later stage of the third position. In one example, the third position 840 may be a combination of the second injection position 440 of FIG. 4C and the third injection position 460 of FIG. 4D. In this way, the fuel injection 842 of the third position may be similar to each of the second injection 520 and the third injection 540 of FIGS. 5B and 5C, respectively. As such, the fuel injection angle and pressure may be between lowest and highest angles and pressures. In this way, the third position 840 may inject toward a central portion of a combustion chamber.

Figure 8D:
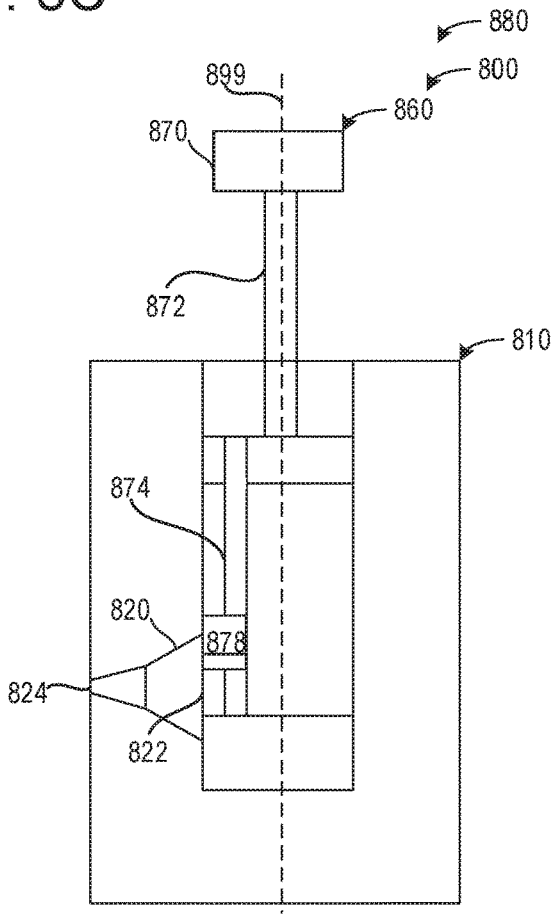

Turning now to FIG. 8D, it shows a fourth position 880 of the fuel injector 800. In the fourth position 880, the fuel outlet 878 may be fluidly coupled to at least a top portion of the nozzle inlet 822. Thus, the fourth position 880 may be even further actuated in the first direction than the first, second, and third positions, 802, 820, and 840. The fourth position 880 may be selected during a late stage of the intake stroke or during an early stage of the compression stroke. As such, the injection angle and pressure of the injection when the fuel injector 800 is in the fourth position may correspond to a highest injection angle and pressure. By doing this, the fuel injection may be directed to a lower portion of the combustion chamber without wetting a surface of the piston.

Figure 9:
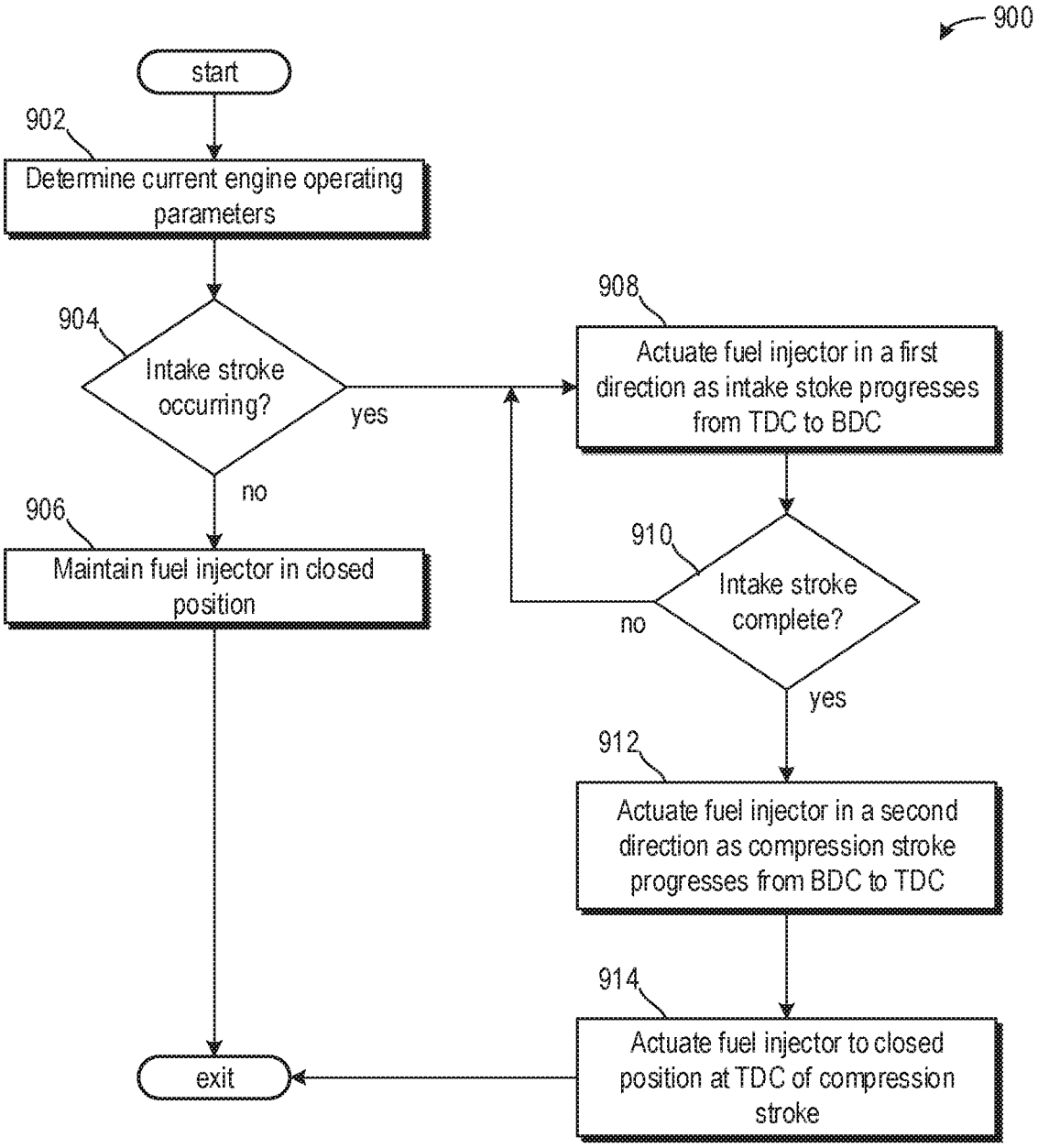
FIG. 9 illustrates a method for actuating the fuel injector.

Turning now to FIG. 9, it shows a method 900 for adjusting a position of a fuel injector based on a piston position during an intake and/or compression stroke. Instructions for carrying out method 900 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 900 may be used to adjust a position of each of the injector spool valve 860 of the injector body 810 of FIGS. 8A-8D or the injector spool valve 260 of injector body 210 of FIGS. 4A-4E.

The method 900 begins at 902, which includes determining, estimating, and/or measuring current engine operating parameters. Current engine operating parameters may include one or more of a manifold vacuum, throttle position, EGR flow rate, boost, engine speed, vehicle speed, and air/fuel ratio.

The method 900 proceeds to 904, which includes determining if an intake stroke is occurring. The intake stroke may be occurring following TDC of an exhaust stroke. In one example, additionally or alternatively, feedback from a crankshaft sensor, such as Hall effect sensor 118 of FIG. 1 may provide an indication of a piston stroke, wherein it may be determined if the intake stroke is occurring based on the feedback.

If the intake stroke is not occurring, then the method 900 proceeds to 906, which may include maintaining a fuel injector in a closed position. As described above with respect to FIGS. 4A and 8A, the closed position may include where the fuel outlet of the injector spool valve is misaligned with the nozzle inlet of the nozzle such that fuel from the spool valve may not enter the nozzle. In this way, a fuel injection is blocked as there is no overlap between the fuel outlet and the nozzle inlet.

If the intake stroke is occurring, then the method 900 proceeds to 908 to actuate a fuel injector in a first direction as the intake stroke progresses from TDC to BDC. In one example, the first direction is a clockwise direction about an axis of rotation and/or a central axis. In such an example, the fuel outlet is rotated, wherein an overlap between the fuel outlet and the nozzle inlet is adjusted through the rotation in the clockwise direction such that the fuel injection angle is also adjusted as the piston moves toward BDC. In one example, the fuel injection angle increases as the piston moves toward BDC. Additionally, an injection pressure may increase as the piston moves toward BDC.

As another example, the first direction may be a linear direction such that the fuel outlet is actuated up and down or side to side along (e.g., parallel to) the central axis. In the example of FIGS. 8A through 8D, the fuel outlet is actuated horizontally, wherein the first direction is a direction away from a combustion chamber. The overlap between the fuel outlet and the nozzle inlet may be adjusted as the piston moves toward BDC.

The method 900 proceeds to 910, which may include determining if the intake stroke is complete. If the intake stroke is not complete, then the method 900 may return to 908 to continue actuating the fuel injector in the first direction. If the intake stroke is complete and the piston has reached BDC, then the method 900 proceeds to 912, which may include actuating the fuel injector in a second direction as a compression stroke progresses from BDC to TDC. The second direction may be opposite the first direction. As such, if the first direction was a clockwise direction, then the second direction may be counterclockwise such that the fuel injector may repeat positions executed during the intake stroke. Additionally or alternatively, if the first direction was a horizontal direction, then the second direction may be toward the combustion chamber such that the fuel injector may repeat positions executed during the intake stroke. In this way, the fuel injection position utilized during the intake stroke may be mirrored in the compression stroke in a reverse order. In one example, the fuel injection position used to complete the intake stroke may be used to begin the compression stroke. As another example, the fuel injection position used to begin the intake stroke may be used to end the compression stroke.

The method 900 may proceed to 914, which may include actuating the fuel injector to its closed position at TDC of the compression stroke. In this way, the fuel injector may be actuated from a starting position (e.g., a fully closed position) to an end position and back to the starting position as the piston oscillates from TDC, to BDC, and back to TDC.

In this way, a fuel injector comprises a plurality of positions, each of which is executed at least twice as a piston moves through an intake stroke and a compression stroke. Each of the positions may differ in an amount and/or location of overlap between a nozzle inlet and a fuel outlet of an injector spool valve. The technical effect of adjusting the area of overlap between the nozzle inlet and the fuel outlet is to adjust an injection angle of the injector to decrease piston surface wetting while allowing the injector to inject through a greater range of the intake stroke and exhaust stroke, thereby increasing air/fuel mixing.

In another representation, the fuel injector is a fuel injector arranged in a hybrid vehicle, wherein the hybrid vehicle is shaped to propel via an internal combustion engine, an electric motor, or both. The fuel injector is arranged to inject into one or more cylinders of the internal combustion engine. Additionally or alternatively, the fuel injector is positioned to inject from a side wall of a combustion chamber.

An embodiment of a system, comprises a fuel injector positioned to inject directly into a combustion chamber and comprising an injector spool valve shaped to rotate within an injector body of the fuel injector to which a nozzle is physically coupled, the injector spool valve comprising a curved rectangular fuel outlet shaped to flow fuel to different portions of a nozzle inlet of the nozzle based on a rotation of the injector spool valve. A first example of the system further includes where the nozzle inlet is oriented in a first plane and a nozzle outlet is oriented in a second plane perpendicular to the first plane. A second example of the system, optionally including the first example, further includes where the fuel injector injects fuel throughout top-dead-center to bottom-dead-center an intake stroke and bottom-dead-center to top-dead-center of a compression stroke of a piston positioned in the combustion chamber. A third example of the system, optionally including the first and/or second examples, further includes where a fuel injection angle of a fuel injection of the fuel injector increases as the piston moves toward bottom-dead-center, and where the fuel injection angle decreases as the piston moves toward top-dead-center. A fourth example of the system, optionally including one or more of the first through third examples, further includes where the fuel injector is mounted in a side wall of the combustion chamber. A fifth example of the system, optionally including one or more of the first through fourth examples, further includes where the nozzle inlet comprises a first oval shape having a first size, and where the nozzle outlet comprises a second oval shape having a second size, and where the first size is bigger than the second size. A sixth example of the system, optionally including one or more of the first through fifth examples, further includes where the nozzle comprises a circular center arranged between the nozzle inlet and the nozzle outlet.

An embodiment of an engine system, comprises a fuel injector mounted to a side wall of a combustion chamber of an engine, the fuel injector having an injector body and an injector spool valve positioned to actuate within the injector body, a nozzle physically coupled to the injector body comprising a nozzle inlet comprising a first oval shape oriented along a first plane and a nozzle outlet comprising a second oval shape oriented along a second plane perpendicular to the first plane, a fuel outlet of the injector spool valve shaped to flow fuel to different portions of the nozzle inlet based on an actuation of the injector spool valve, and a controller with computer-readable instructions stored on non-transitory memory thereof that when executed enable the controller to actuate the injector spool valve in a first direction during an intake stroke of a piston positioned to oscillate within the combustion chamber, and actuate the injector spool valve in a second direction, opposite the first direction, during a compression stroke of the piston. A first example of the engine system further includes where the first direction is a clockwise direction relative to a central axis of the injector spool valve, and where the second direction is a counterclockwise direction relative to the central axis, and where the central axis is parallel to the first plane. A second example of the engine system, optionally including the first example, further includes where the first direction is away from a bottom surface of the injector body parallel to a central axis of the injector spool valve, and where the second direction is toward the bottom surface parallel to the central axis. A third example of the engine system, optionally including the first and/or second examples, further includes where the nozzle outlet faces a cylinder head, and where a central line of the nozzle outlet is perpendicular to an axis along which the piston oscillates. A fourth example of the engine system, optionally including one or more of the first through third examples, further includes where a fuel injection angle increases as the injector spool valve actuates in the first direction, and where the fuel injection angle decreases as the injector spool valve actuates in the second direction. A fifth example of the engine system, optionally including one or more of the first through fourth examples, further includes where the fuel outlet flows fuel to a bottom portion of the nozzle inlet at an early stage of the intake stroke, to the bottom portion and a middle portion of the nozzle inlet at an early-middle stage of the intake stroke, to the middle portion and a top portion of the nozzle inlet at a middle-late stage of the intake stroke, and to the top portion of the nozzle inlet at a late stage of the intake stroke. A sixth example of the engine system, optionally including one or more of the first through fifth examples, further includes where the fuel outlet flows fuel to the top portion of the nozzle inlet during an early stage of the compression stroke, to the middle portion and the top portion of the nozzle inlet during an early-middle stage of the compression stroke, to the middle portion and the bottom portion of the nozzle inlet during a middle-late stage of the compression stroke, and to the bottom portion of the nozzle inlet during a late stage of the compression stroke. A seventh example of the engine system, optionally including one or more of the first through sixth examples, further includes where the fuel outlet comprises a curved rectangular shape, wherein the curved rectangular shape comprises curved longitudinal and lateral sides, and where an angle formed between an intersection of the curved longitudinal and lateral sides is greater than or less than 90 degrees.

An embodiment of a fuel injector comprises an injector body comprising a nozzle having a nozzle inlet and a nozzle outlet, the nozzle inlet comprising a first shape oriented along a first plane and the nozzle outlet comprising a second shape oriented along a second plane perpendicular to the first plane and an injector spool valve shaped to rotate within an interior volume of the injector body, the injector spool valve comprising a fuel outlet having a curved, rectangular shape, wherein the curved rectangular shape comprises curved longitudinal and lateral sides, and where an angle formed between an intersection of the curved longitudinal and lateral sides is greater than or less than 90 degrees. A first example of the fuel injector further includes where the injector spool valve is rotated in a clockwise direction from top-dead center to bottom-dead center of an intake stroke, and where the injector spool valve is rotated counterclockwise from bottom-dead center to top-dead center of a subsequent compression stroke of a combustion chamber in which the fuel injector is side-mounted and positioned to inject fuel. A second example of the fuel injector, optionally including the first example, further includes where an injection flow rate and an injection angle increase in the clockwise direction and decrease in the counterclockwise direction. A third example of the fuel injector, optionally including the first and/or second examples, further includes where the first shape comprises a first cross-sectional area taken along the first plane and the second shape comprises a second cross-sectional area taken along the second plane, and where the first cross-sectional area is larger than the second cross-sectional area. A fourth example of the fuel injector, optionally including one or more of the first through third examples, further includes where the nozzle comprises no additional inlets or other outlets other than the nozzle inlet and the nozzle outlet.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a fuel injector mounted to a side wall of a combustion chamber of an engine, the fuel injector positioned to inject directly into the combustion chamber and the fuel injector comprising an injector spool valve shaped to rotate within an injector body of the fuel injector to which a nozzle is physically coupled, a body of the injector spool valve positioned within the injector body of the fuel injector, wherein the nozzle comprises an inlet comprising a first oval shape oriented along a first plane and a nozzle outlet comprising a second oval shape oriented along a second plane perpendicular to the first plane, wherein a longitudinal length of the second oval shape extends in a direction substantially perpendicular to a central axis of the injector spool valve, the body of the injector spool valve comprising a curved rectangular fuel outlet formed therein, the curved rectangular fuel outlet shaped to flow fuel to different portions of a nozzle inlet of the nozzle based on a rotation actuation of the injector spool valve and inject the fuel into the combustion chamber via the nozzle outlet; and a controller with computer-readable instructions stored on non-transitory memory thereof that when executed enable the controller to:

actuate the injector spool valve in a first direction during an intake stroke of a piston positioned to oscillate within the combustion chamber; and actuate the injector spool valve in a second direction, opposite the first direction, during a compression stroke of the piston.

2. The system of claim 1, wherein the fuel injector injects fuel throughout top-dead-center to bottom-dead-center an intake stroke and bottom-dead-center to top-dead-center of a compression stroke of a piston positioned in the combustion chamber.

3. The system of claim 2, wherein a fuel injection angle of a fuel injection of the fuel injector increases as the piston moves toward bottom-dead-center, and where the fuel injection angle decreases as the piston moves toward top-dead-center.

4. The system of claim 1, wherein the first oval shape has a first size, and where the second oval shape has a second size, and where the first size is bigger than the second size.

5. The system of claim 1, wherein the nozzle comprises a circular center arranged between the nozzle inlet and the nozzle outlet.

6. An engine system, comprising:

a fuel injector mounted to a side wall of a combustion chamber of an engine, the fuel injector having an injector body and an injector spool valve, a body of the injector spool valve positioned within the injector body to actuate within the injector body;

a nozzle physically coupled to the injector body comprising a nozzle inlet comprising a first oval shape oriented along a first plane and a nozzle outlet comprising a second oval shape oriented along a second plane perpendicular to the first plane, wherein a longitudinal length of the second oval shape extends in a direction substantially perpendicular to a central axis of the injector spool valve;

a fuel outlet formed into the body of the injector spool valve, the fuel outlet shaped to flow fuel to different portions of the nozzle inlet based on an actuation of the injector spool valve and inject the fuel into the combustion chamber via the nozzle outlet; and a controller with computer-readable instructions stored on non-transitory memory thereof that when executed enable the controller to:

actuate the injector spool valve in a first direction during an intake stroke of a piston positioned to oscillate within the combustion chamber; and actuate the injector spool valve in a second direction, opposite the first direction, during a compression stroke of the piston.

7. The engine system of claim 6, wherein the first direction is a clockwise direction relative to the central axis of the injector spool valve, and where the second direction is a counterclockwise direction relative to the central axis, and where the central axis is parallel to the first plane.

8. The engine system of claim 6, wherein the first direction is away from a bottom surface of the injector body parallel to the central axis of the injector spool valve, and where the second direction is toward the bottom surface parallel to the central axis.

9. The engine system of claim 6, wherein the first oval shape and the second oval shape are cross-sectional shapes, wherein the nozzle outlet faces a cylinder head, and wherein a central line of the nozzle outlet is perpendicular to an axis along which the piston oscillates.

10. The engine system of claim 6, wherein the nozzle is positioned radially between the fuel outlet of the injector spool valve and the injector body, wherein a fuel injection angle increases as the injector spool valve actuates in the first direction, and wherein the fuel injection angle decreases as the injector spool valve actuates in the second direction.

11. The engine system of claim 6, wherein the fuel outlet flows fuel to a bottom portion of the nozzle inlet at an early stage of the intake stroke, to the bottom portion and a middle portion of the nozzle inlet at an early-middle stage of the intake stroke, to the middle portion and a top portion of the nozzle inlet at a middle-late stage of the intake stroke, and to the top portion of the nozzle inlet at a late stage of the intake stroke.

12. The engine system of claim 11, wherein the nozzle is positioned within the injector body, and wherein the fuel outlet flows fuel to the top portion of the nozzle inlet during an early stage of the compression stroke, to the middle portion and the top portion of the nozzle inlet during an early-middle stage of the compression stroke, to the middle portion and the bottom portion of the nozzle inlet during a middle-late stage of the compression stroke, and to the bottom portion of the nozzle inlet during a late stage of the compression stroke.

13. The engine system of claim 6, wherein the fuel outlet comprises a curved rectangular shape, wherein the curved rectangular shape comprises curved longitudinal and lateral sides, and where an angle formed between an intersection of the curved longitudinal and lateral sides is greater than or less than 90 degrees.

14. A system comprising:

a fuel injector comprising:

an injector body comprising a nozzle physically coupled to the injector body, the nozzle having a nozzle inlet and a nozzle outlet, the nozzle inlet comprising a first oval shape oriented along a first plane and the nozzle outlet comprising a second oval shape oriented along a second plane perpendicular to the first plane, wherein a longitudinal length of the second oval shape extends in a direction substantially perpendicular to a central axis of the injector spool valve; and an injector spool valve shaped to rotate within an interior volume of the injector body, the body of the injector spool valve comprising a fuel outlet formed therein that is shaped to flow fuel to different portions of the nozzle inlet based on an actuation of the injector spool valve and inject the fuel into a combustion chamber of an engine via the nozzle outlet, the fuel outlet of the injector spool valve having a curved, rectangular shape, wherein the curved rectangular shape comprises curved longitudinal and lateral sides, and where an angle formed between an intersection of the curved longitudinal and lateral sides is greater than or less than 90 degrees, a body of the injector spool valve positioned within the injector body to actuate within the injector body, wherein the fuel injector is mounted to a side wall of the combustion chamber of the engine; and the system further comprising a controller, wherein the controller has computer-readable instructions stored on non-transitory memory thereof that when executed enable the controller to:

actuate the injector spool valve in a first direction during an intake stroke of a piston positioned to oscillate within the combustion chamber; and actuate the injector spool valve in a second direction, opposite the first direction, during a compression stroke of the piston.

15. The system of claim 14, wherein the injector spool valve is rotated in a clockwise direction from top-dead center to bottom-dead center of an intake stroke, and where the injector spool valve is rotated counterclockwise from bottom-dead center to top-dead center of a subsequent compression stroke of the combustion chamber in which the fuel injector is side-mounted and positioned to inject fuel.

16. The system of claim 15, wherein an injection flow rate and an injection angle increase in the clockwise direction and decrease in the counterclockwise direction.

17. The system of claim 14, wherein the first shape comprises a first cross-sectional area taken along the first plane and the second shape comprises a second cross-sectional area taken along the second plane, and where the first cross-sectional area is larger than the second cross-sectional area.

18. The system of claim 14, wherein the nozzle comprises no additional inlets or other outlets other than the nozzle inlet and the nozzle outlet.

* * * * *